US010371413B2

(12) United States Patent
Brazier et al.

(10) Patent No.: US 10,371,413 B2
(45) Date of Patent: Aug. 6, 2019

(54) BOILER WITH ACCESS TO HEAT EXCHANGERS

(71) Applicant: Central Boiler, Inc., Greenbush, MN (US)

(72) Inventors: Dennis Brazier, Roseau, MN (US); Mark Reese, Greenbush, MN (US)

(73) Assignee: CENTRAL BOILER, INC., Greenbush, MN (US)

( * ) Notice: Subject to any disclaimer, the term of this patent is extended or adjusted under 35 U.S.C. 154(b) by 0 days.

(21) Appl. No.: 15/899,679

(22) Filed: Feb. 20, 2018

(65) Prior Publication Data

US 2018/0202688 A1 Jul. 19, 2018

Related U.S. Application Data

(63) Continuation-in-part of application No. 15/091,399, filed on Apr. 5, 2016.

(Continued)

(51) Int. Cl.
*F27D 1/18* (2006.01)
*F23M 7/00* (2006.01)

(Continued)

(52) U.S. Cl.
CPC ..... *F24H 9/02* (2013.01); *F24H 1/0063* (2013.01); *F24H 9/0042* (2013.01)

(58) Field of Classification Search
CPC ..... F24H 1/187; F24H 1/108; F24H 2230/00; F23M 7/00; F27D 1/1858; F24B 5/02; F24B 5/04
See application file for complete search history.

(56) References Cited

U.S. PATENT DOCUMENTS 4,334,518 A * 6/1982 Ort ..... F24B 1/18 126/502
4,438,755 A * 3/1984 Moffett ..... F24B 9/00 126/34

(Continued)

FOREIGN PATENT DOCUMENTS

CN 202040801 U 11/2011
EP 1627190 B1 7/2008

(Continued)

OTHER PUBLICATIONS

BioMass Gasification Boiler; New Horizon Corporation; pp. 4; Dated Dec. 10, 2014.

(Continued)

*Primary Examiner* — Gregory A Wilson
(74) *Attorney, Agent, or Firm* — Lowe Graham Jones PLLC

(57) ABSTRACT

A boiler that includes a housing is disclosed. The housing houses a combustion chamber, a heat exchanger system, a heat flow path, an isolating member, and a movable access panel. The heat flow path thermally couples the combustion chamber and the heat exchanger system. The isolating member at least partially separates the combustion chamber from the heat exchanger system. A fluid jacket is operable to thermally couple fluid disposable within the fluid jacket about a fluid side area of heat exchangers of the heat exchanger system. The movable access panel is positioned about or coupled to an exterior wall of the housing. When the movable access panel is moved to an open position, a user is provided access to a gas side area of the heat exchangers for servicing or cleaning of the heat exchangers from an exterior environment of the boiler.

21 Claims, 9 Drawing Sheets

Related U.S. Application Data

(60) Provisional application No. 62/143,646, filed on Apr. 6, 2015.

(51) Int. Cl.

| | |
|---|---|
| ***F24H 9/02*** | (2006.01) |
| ***F24H 1/00*** | (2006.01) |
| ***F24H 9/00*** | (2006.01) |

(56) References Cited

U.S. PATENT DOCUMENTS

| | | | | |
|---|---|---|---|---|
| 4,479,605 | A * | 10/1984 | Billotte | F24D 11/003 122/16.1 |
| 4,534,319 | A * | 8/1985 | Manno | F24B 9/04 122/16.1 |
| 5,329,920 | A * | 7/1994 | Brazier | F23M 7/00 122/16.1 |
| 6,892,679 | B2 | 5/2005 | Jameel et al. | |
| 6,938,582 | B2 | 9/2005 | Shin | |
| 7,264,039 | B2 | 9/2007 | Dawson | |
| 8,011,329 | B2 * | 9/2011 | Hardy | F23B 30/00 122/16.1 |
| 8,161,959 | B1 | 4/2012 | O'Reilly | |
| 8,186,286 | B2 * | 5/2012 | Brazier | F23G 5/12 110/173 R |
| 9,182,115 | B2 * | 11/2015 | Dongo | F23B 40/08 |
| 9,182,116 | B2 * | 11/2015 | Murray | F23B 60/02 |
| 2005/0133202 | A1 | 6/2005 | Jorgensen et al. | |
| 2008/0156237 | A1 | 7/2008 | Leihgeber | |
| 2010/0276128 | A1 | 11/2010 | Taylor | |
| 2010/0300378 | A1 | 12/2010 | Rigamonti | |
| 2013/0125838 | A1 | 5/2013 | Min | |
| 2013/0186313 | A1 * | 7/2013 | Walborn | F24H 1/108 110/345 |

FOREIGN PATENT DOCUMENTS

| | | | |
|---|---|---|---|
| KR | 20020044625 | A | 6/2002 |
| KR | 20140037560 | A | 3/2014 |
| WO | 2012124879 | A1 | 9/2012 |

OTHER PUBLICATIONS

Munchkin Stainless Steel High Efficiency Boiler; Heat Transfer Products, Inc.; pp. 76; Dated Feb. 20, 2007.
International Search Report; dated Dec. 12, 2016; pp. 4.

* cited by examiner

BOILER WITH ACCESS TO HEAT EXCHANGERS

PRIORITY CLAIM

This application is a continuation-in-part of application Ser. No. 15/091,399, filed 5 Apr. 2016, which is a Utility Patent application based on a previously filed U.S. Provisional Patent Application U.S. Ser. No. 62/143,646 filed on Apr. 6, 2015, entitled BOILER WITH ACCESS TO HEAT EXCHANGERS, the benefit of the filing date of which is hereby claimed under 35 U.S.C. § 119(e) and which is further incorporated by reference in its entirety.

TECHNICAL FIELD OF THE INVENTION

The disclosure relates generally to heat transfer technologies and more specifically to boilers with access to the heat exchangers.

BACKGROUND OF THE INVENTION

Boilers are structures in which water r another fluid is heated via, heat exchangers internal to the boiler. The heated or vaporized fluid is provided to another structure, such as a home, to heat the structure or otherwise generate another form of power. Normally, a fuel is combusted within the boiler and the heat exchangers are subjected to the generated heat. The fluid to be heated is in thermal contact with the heat exchangers. The fuel may be a biomass, such as wood.

Combustion of a biomass fuel generates pollutants, such as soot and ash, which overtime accumulate on the internal heat exchangers. Accordingly, the heat exchangers must be periodically cleaned. Furthermore, the heat exchangers include weld joints. Due to the extreme heat generated within a boiler, the exchangers and weld joints must be routinely inspected for damage. In typical boilers, the only route of access to the heat exchangers is from the exterior of the boiler, such as through the exhaust or cutting through an exterior wall. Inspecting, repairing, cleaning, and other maintenance of the heat exchangers from the exterior of the boiler is difficult and/or cumbersome. It is for these and other concerns that the present disclosure is offered.

SUMMARY OF THE INVENTION

The present disclosure is directed towards a boiler that includes a housing. The housing houses a combustion chamber, a heat exchanger system, an isolating member, and an access panel. The combustion chamber houses a combustion of fuel. The combustion of fuel generates thermal energy. The heat exchanger system receives at least a portion of the generated thermal energy. The heat flow path provides at least a portion of the generated thermal energy from the combustion chamber to the heat exchanger system. The isolating member includes an aperture. Furthermore, the isolating member at least partially physically separates the combustion chamber from the heat exchanger system. The aperture is seized to provide a user access to the heat exchanger system from the combustion chamber. When the access panel is in a first position, the access panel at least partially covers the aperture to prohibit the user access to the heat exchanger system. When the access panel is in a second position, the aperture is uncovered by the access panel such that the user may access the heat exchanger system from the combustion chamber.

In various embodiments, the boiler further includes a water jacket that thermally couples water within the water jacket to the heat exchanger system. The heat exchanger system may include a plurality of radiator-like fins. At least a portion of the water within the water jacket is on an internal side of at least one of the plurality of fins and the thermal energy provided by the heat flow path is on an external side of the fin, such that the fin physically separates the water from the thermal energy but thermally couples the water to the thermal energy.

In some embodiments, the access panel is a removable panel. For instance, the access panel is enabled to be completely removed from the isolating member. The heat exchanger system may not be accessible (or at least may be difficult to access) from an exterior of the boiler. The isolating member may be substantially a vertical member that is positioned intermediate the combustion chamber and the heat exchanger system.

Some embodiments further include a reaction chamber. The reaction chamber may be vertically below the combustion chamber. A secondary combustion process may occur in the reaction chamber. The heat flow path provides at least a portion of thermal energy generated in the secondary combustion process from the reaction chamber to a lower portion of the heat exchanger system. Some embodiments include comprising a charge tube that provides gasses from the combustion chamber to the reaction chamber. The heat flow path includes a gap positioned in a lower portion of the reaction chamber. The gap enables the flow of gas from the reaction chamber to another chamber that includes at least a portion of the heat exchanger system.

In at least one embodiment, the access panel is a hinged door. The first position of the access panel corresponds to a closed position. The second position of the access panel corresponds to an open position. Some embodiments further include a port. The port provides the user access to the combustion chamber from an exterior of the boiler and when the access panel is in the second position, the user may access the heat exchanger system from the exterior of the boiler.

In other embodiments, a boiler includes a combustion chamber, heat-exchanging structures, and a removable panel. The heat-exchanging structures are thermally coupled to the combustion chamber. The removable panel provides a user access to the heat-exchanging structures. The heat-exchanging structure may be fins or plates.

In some embodiments, the removable panel s positioned on an internal wall of the boiler. In other embodiments, the removable panel is positioned on an external wall of the boiler. The removable panel may be opposing an access port that provides the user access to the combustion chamber. The removable panel may be vertically above a reaction chamber of the boiler.

Various embodiments are directed to a method for servicing a boiler. The boiler includes a plurality of heat exchangers and a panel. When the panel is positioned in a first position, the panel provides access to the plurality of heat exchangers. When the panel is positioned in a second position, the panel prevents access to the plurality of heat exchangers. The method includes transitioning the panel from the second position to the first position, to provide access to the plurality of heat exchangers. The method may include employing a tool through the access port or panel to the plurality of heat exchangers to clean the plurality of heat exchangers. The method may further include transitioning the panel from the first position to the second position, to prevent access to the plurality of the heat exchangers.

In some embodiments, the method includes opening an access port in the boiler to provide access to a combustion chamber of the boiler. In at least one embodiment, the method includes employing the tool through the access port to the combustion chamber to clean the plurality of heat exchangers. In at least one embodiment, the method further includes closing the access port in the boiler to prevent access to the combustion chamber.

In some embodiments, the access port is located on an external surface of the boiler. When the panel is positioned in the second position, the panel is located on an internal surface of the boiler. The internal surface opposes the external surface of the boiler. The tool may include at least one of a wire brush, a rake, or a metallic tool. Transitioning the panel from the second position to the first position may include removing the panel from a surface of the boiler.

The present disclosure is directed towards a boiler that includes a combustion chamber and a plurality of heat-exchanging structures that are thermally coupleable to the combustion chamber. The plurality of heat-exchange structures can define a gas side area that at least partially defines a heat flow path that provides at least a portion of generated thermal energy from the combustion chamber to the gas side area to heat a fluid (e.g., water, gas, other fluid(s)). The boiler can include a movable access panel positioned about an external wall of the boiler and adjacent the gas side area. The movable access panel can be operable to provide a user access to the gas side area of the plurality of heat-exchanging structures from the exterior of the boiler.

In some embodiments, the boiler includes a fluid jacket that thermally couples fluid disposable within the fluid jacket to the plurality of heat-exchanging structures.

In some embodiments, at least a portion the fluid jacket is laterally situated between the combustion chamber and the heat flow path through the gas side area of the plurality of heat-exchanging structures. In some embodiments, the heat flow path through the gas side area of the plurality of heat-exchanging structures is laterally situated between the movable access panel and at least a portion of the fluid jacket.

The present disclosure is directed towards a boiler that includes: a combustion chamber; a plurality of heat-exchanging structures that are thermally coupleable to the combustion chamber; a fluid jacket operable to thermally couple fluid disposable within the fluid jacket about a first side area of the plurality of heat-exchanging structures; a heat flow path that provides at least a portion of the generated thermal energy from the combustion chamber to a second side area of the plurality of heat-exchanging structures to heat a fluid disposable within the fluid jacket; and a movable access panel positioned about an external wall of the boiler. The movable access panel is operable to provide a user access to the second side area of the plurality of heat-exchanging structures from the exterior of the boiler.

In some embodiments, at least a portion of the fluid jacket is situated between the combustion chamber and the heat flow path through the second side area of the plurality of heat-exchanging structures.

In some embodiments, the heat flow path through the second side area of the plurality of heat-exchanging structures is situated between the movable access panel and at least a portion of the fluid jacket.

The present disclosure is directed towards a boiler that includes a combustion chamber; a plurality of heat-exchanging structures that are thermally coupled to the combustion chamber. The plurality of heat-exchanging structures can at least partially define a fluid side area and a gas side area. The fluid side area can be configured to support fluid thermally coupleable to the plurality of heat-exchanging structures. The gas side area can be configured to receive at least a portion of generated thermal energy from the combustion chamber to heat fluid disposable within the fluid side area. The boiler includes a movable access panel coupled about an exterior wall of the boiler and operable to cover the gas side area when in a closed position. The movable access panel is operable to an open position to provide a user access to the gas side area of the plurality of heat-exchanging structures from the exterior of the boiler.

The present disclosure is directed towards a method for servicing a boiler that includes a movable access panel that provides access to a plurality of heat-exchanging structures. The method can comprise: transitioning the movable access panel from a closed position to an open position to provide access to the plurality of heat-exchanging structures from an exterior of the boiler; employing a tool through an access opening being exterior the boiler to clean the plurality of heat-exchanging structures; and transitioning the movable access panel from the open position to the closed position, to prevent access to the plurality of the heat-exchanging structures.

BRIEF DESCRIPTION OF THE DRAWINGS

Preferred and alternative examples of the present invention are described in detail below with reference to the following drawings.

DETAILED DESCRIPTION OF THE PREFERRED EMBODIMENTS

To facilitate the understanding of this invention, a number of terms are defined below. Terms defined herein have meanings as commonly understood by a person of ordinary skill in the areas relevant to the present invention. Terms such as "a," "an," and "the" are not intended to refer to only a singular entity, but include the general class of which a specific example may be used for illustration. The terminology herein is used to describe specific embodiments of the invention, but their usage does not delimit the invention, except as outlined in the claims.

Figure 1:
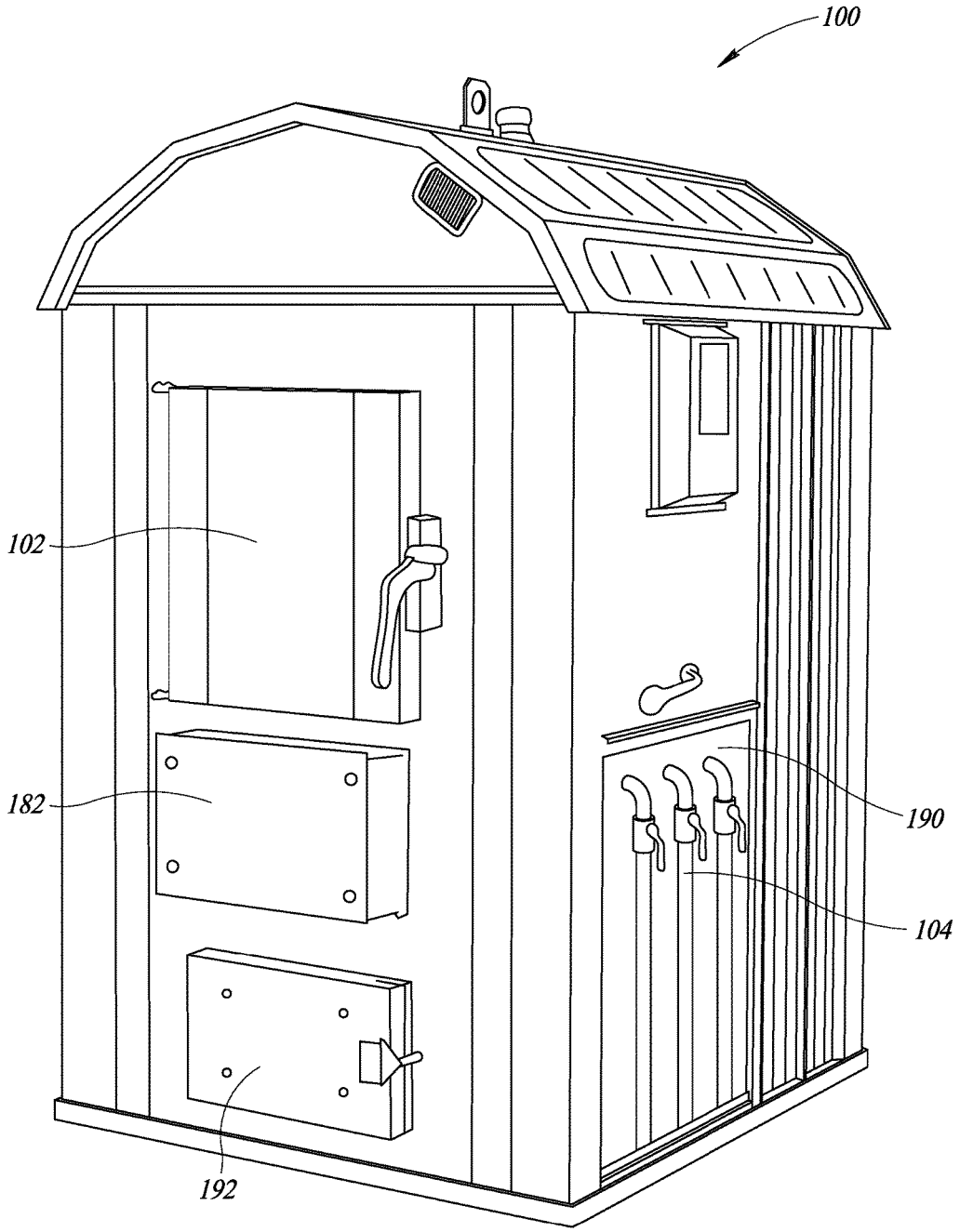
FIG. 1 illustrates an exterior view of a non-limiting exemplary embodiment of a boiler that is consistent with the embodiments disclosed herein.

FIG. 1 illustrates an exterior view of a non-limiting exemplary embodiment of a boiler 100 that is consistent with the embodiments disclosed herein. The exterior view of boiler 100 shows an upper boiler access port 102, a middle boiler access port 182 (e.g., to accommodate air openings), and a lower boiler access port 192. Each of these boiler access ports 102/182/192 provides access to the interior of boiler 100. The interior of boiler 100 includes multiple combustion chambers where a biomass fuel is sequentially combusted and gasified to release the energy required to heat or vaporize the water within a water jacket that is internal to boiler 100.

The upper boiler access port 102 includes a hinged door that is closed in FIG. 1. Upper access port 102 provides access to a firebox or primary combustion chamber of boiler 100. The biomass fuel is loaded into the boiler 100 via upper boiler access port 102. Middle boiler access port 182 and lower boiler access port 192 provide access to a charge tube (or tubes) and a reaction chamber respectively. As discussed further below, the primary combustion chamber, the charge tube, and the reaction chamber provide a sequence of progressive combustion/gasification chambers. Each of the chambers may be periodically cleaned via the access provided by the boiler access ports 102/182/192.

FIG. 1 shows plumbing 104. The heated and/or vaporized water leaves boiler 100 through plumbing 104 and is provided to a structure to be heated, such as a home. Also illustrated in FIG. 1 is the thermal insulation 190 that is included in boiler's 100 housing. Thermal insulation 190 ensures that a minimal amount of heat energy released in the combustion/gasification chambers escapes to the external environment.

Figure 2:
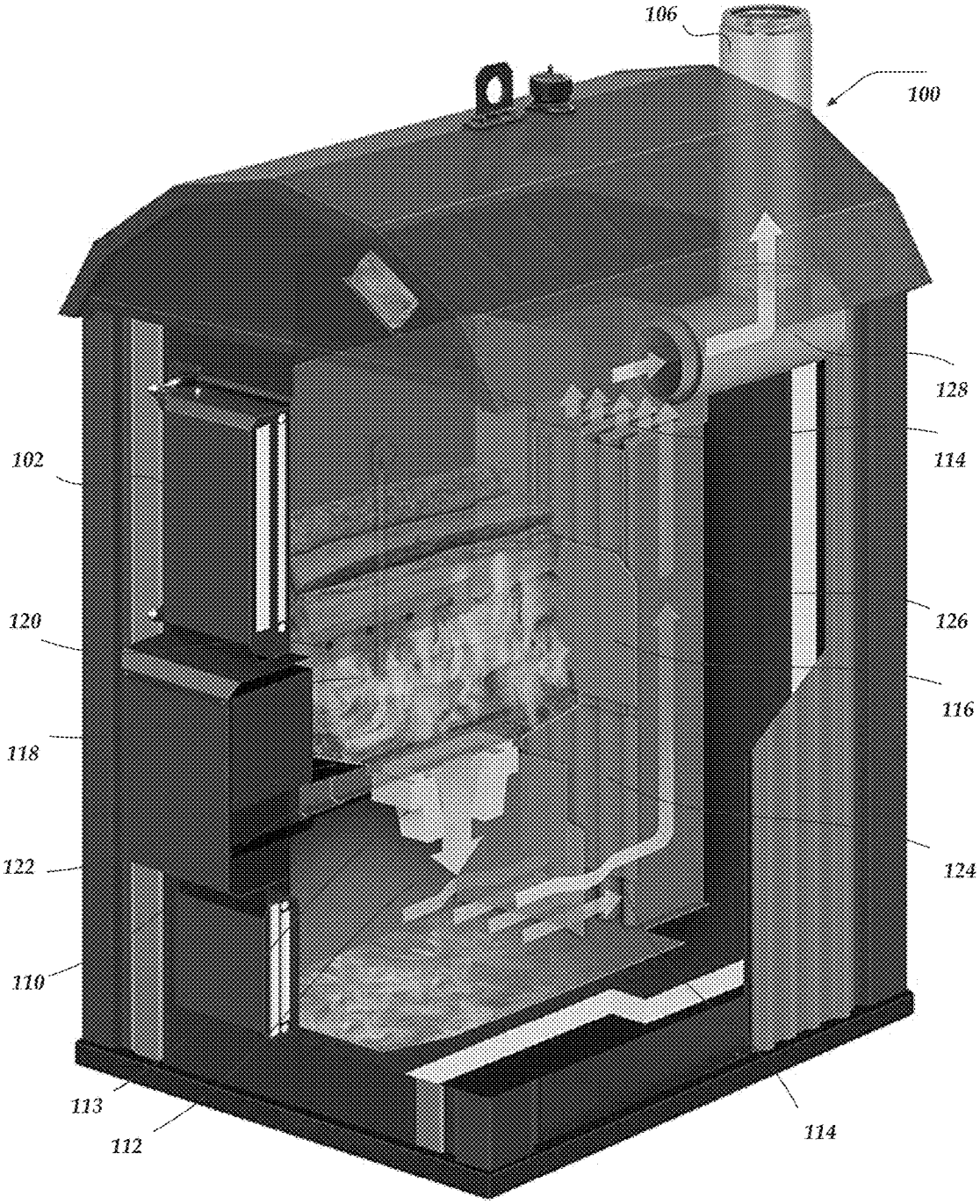
FIG. 2 illustrates a cutaway view to the interior of the boiler of FIG. 1.

FIG. 2 illustrates a cutaway view to the interior of boiler 100 of FIG. 1. Boiler 100 includes an insulated chimney 106 to expel the exhaust and/or heated gases generated from the combustion of the biomass fuel and after the exhaust has heated and/or vaporized water that is contained in water jacket 126. In some embodiments, additional chimney sections are provided for extending chimney 106. Upper boiler access port 102 is also shown in FIG. 1.

Biomass fuel, such as wood, is combusted within the firebox or primary combustion channel 118. A crossfire air system 120 injects preheated air around the base of the primary combustion chamber 118. The bottom portion of primary combustion chamber includes an ash pan 122 with a recessed portion from collecting debris from the combustion process. Ash pan 122 enables the easy cleanup, via the upper boiler access port 102, of coals, ash, and other byproducts generated by the combustion of the biofuel.

As the wood begins to gasify, the gases flow downward through a port in ash pan 122. Fusion combustor 113 is held within the port in ash pan 122. The combustion gasses flow through fusion combustor 113 as heated oxygen from charge tube 110 is added to the mix. A secondary combustion process occurs via the refractory or fusion combustor 113 as the gasses flow through the combustor and into reaction chamber 112. The fusion combustor 113 is situated adjacent and below a portion of the charge tube 110, and the fusion combustor 113 causes exhaust gases from the primary combustion chamber 118 to "re-burn" as the gases flow downwardly through the fusion combustor 113. As the vertically downward arrow indicates, the heated gasses are forced downward through an opening of the fusion combustor 113 and into the reaction chamber 112, where the final combustion occurs. Note that the charge tube 110 operates to add air from outside the primary combustion chamber 118 and to the primary combustion chamber 118, just above the fusion combustor 113. The charge tube 110 is formed as an elongated tube, having apertures to allow said airflow, and also to prevent coals/debris from falling through the opening of the fusion combustor 113.

An isolating member, such as panel 124 physically separates or isolates the primary combustion chamber 118 and the reaction chamber 112 from the heat exchangers 114. As shown by the heat flow arrows, the heated gasses flow from the reaction chamber 112 to the heat exchangers 114 via a gap in the bottom portion of separation or isolating panel 124. These heated gasses transfer heat to the heat exchangers 114, which in turn transfers at least a portion of the heat to water that is supplied to another structure via plumbing, such as plumbing 104 of FIG. 1.

Boiler 100 includes a water jacket 126. Water jacket 126 is essentially a circulating closed system that houses the heated water to be supplied to the other structure (this system could be an open (non-pressurized) system or a closed system having an external pressurized fluid source fluidly coupled to the water jacket 126 through a series of pipes). At least a portion of the water jacket 126 is thermally coupled to heat exchangers 114 so that the water internal to water jacket 126 is heated and/or vaporized via the heat released by the combustion of the biomass. The heated water within the water jacket 126 is circulated away from boiler 100 and provided to the structure via plumbing. After providing at least a portion of the energy to the other structure, the water is circulated back to boiler 100 to be re-thermally energized.

Heat exchangers 114 include vertical radiator-style fins. In other embodiments, heat exchangers 114 may include fabricated plates. The plates may include a significant surface area to promote efficient heat exchange. The plates may be metal plates. In at least one embodiment, heat exchangers 114 include other heat radiating structures. The increased surface area of these fins provides a greater surface area to thermally couple the heat exchangers 114 to the water within water jacket 126. The fins define an interface between the flowing heated gasses and the water within water jacket 126. In at least one embodiment, at least a portion of water jacket 126 may include internal channels, pipes, or other plumbing that is internal to the vertical fins. In other embodiments, the heat gasses flow through internal channels within the fins and the water jacket 126 is on the other side of a wall of the fins. The heat flow arrows show the heat flowing through the vertical fins of the heat exchangers 114, up through an exhaust duct 128 and out through chimney 106.

Panel 124 includes a removable section 116 that provides access from the interior of boiler 100 to the heat exchangers 114. Specifically, the removable section 116 provides access to the heat exchangers 114 from the primary combustion chamber 118. Removable section 116 may be a removable door, hatch, panel, or other sectional member that can be removed to provide access from the primary combustion chamber 118 to the heat exchangers 114. In some non-limiting embodiments, the heat exchangers 114 are not accessible, except through removable panel 116. For instance, the exterior of boiler 100 provides no access to the heat exchangers 114. Removable panel 116 may be a hinged panel, or else may be completely removable. In other embodiments, removable panel 116 may not be completely removable, but is hinged, to provide access from the primary combustion chamber 118 to the heat exchangers 114, such as in a hinged door fashion. The hinge may be positioned along a vertical edge of removable panel 116 or a horizontal edge of removable panel 116.

In other embodiments, access to the heat exchangers 114 is provided by a removable panel positioned on an exterior wall of boiler 100, rather than a removable panel on an internal surface of boiler 100, such as removable panel 116 positioned on an interior wall or panel 124 (also see the discussion below regarding the embodiments of FIGS. 6A-7B). For instance, a removable panel may be positioned on an exterior wall of the housing of boiler 100, where the exterior wall is near or adjacent to the heat exchangers 114 within boiler 100. In this way, a user is provided similar access to the heat exchangers 114 from outside of or exterior to boiler 100. In at least one embodiment, boiler 100 includes access to the heat exchangers 114 from both within (or internal to) boiler 100, via removable panel 116, and also exterior to boiler 100. The exterior access is provided via a removable panel positioned on an exterior wall of the housing of boiler 100. Accordingly, in some embodiments, a user may access the heat exchangers 114 from both the interior and exterior of boiler 100, and from two separate and distinct removable panels.

Because of the flow of the combustion gasses from the primary combustion chambers 118, the fusion combustor 113, and reaction chamber 112, and across the heat exchangers 114, the heat exchangers accumulate soot and ash over time and require periodic cleaning. To clean the heat exchangers 114, a user needs only to access the heat exchangers 114 via the one or more removable panels. For instance, a user can access the heat exchangers 114 from with boiler 100 via removable panel 116. In other embodiments, the user can access heat exchangers from the exterior of boiler 100, via a removable panel positioned on the exterior surface of boiler 100. Removable panel 116 provides access to the vertical tins of heat exchangers 114. With the removable panel 116 removed, the user may clean the heat exchangers 114 with a tool, such as a metallic cleaning tool, wire brush, rake, or another specialized tool.

Periodic inspection and maintenance may be performed by removing removable panel 116. The removable panel 116 obviates the need for a panel providing access to the heat exchangers 114 from the exterior of boiler 100. Thus, in some embodiments, the only path between the exterior of boiler 100 and the heat exchangers 114 is through the heated gas flow path from chimney 106, through exhaust duct 128 and to heat exchangers 114. In other embodiments, an exterior removable panel provides access to the heat exchangers for periodic maintenance and inspection.

Furthermore, a removable panel enables a simplified construction and/or maintenance of boiler 100. For instance, heat exchangers may be welded from within the firebox or primary combustion chamber 118 and outside of water jacket 126 via removable internal panel 116. Since all the welds are accessible from the primary combustion chamber 118 by removing removable panel 116, each of the welds may be repaired during regular maintenance via the access provided by a removable panel.

Figure 3:
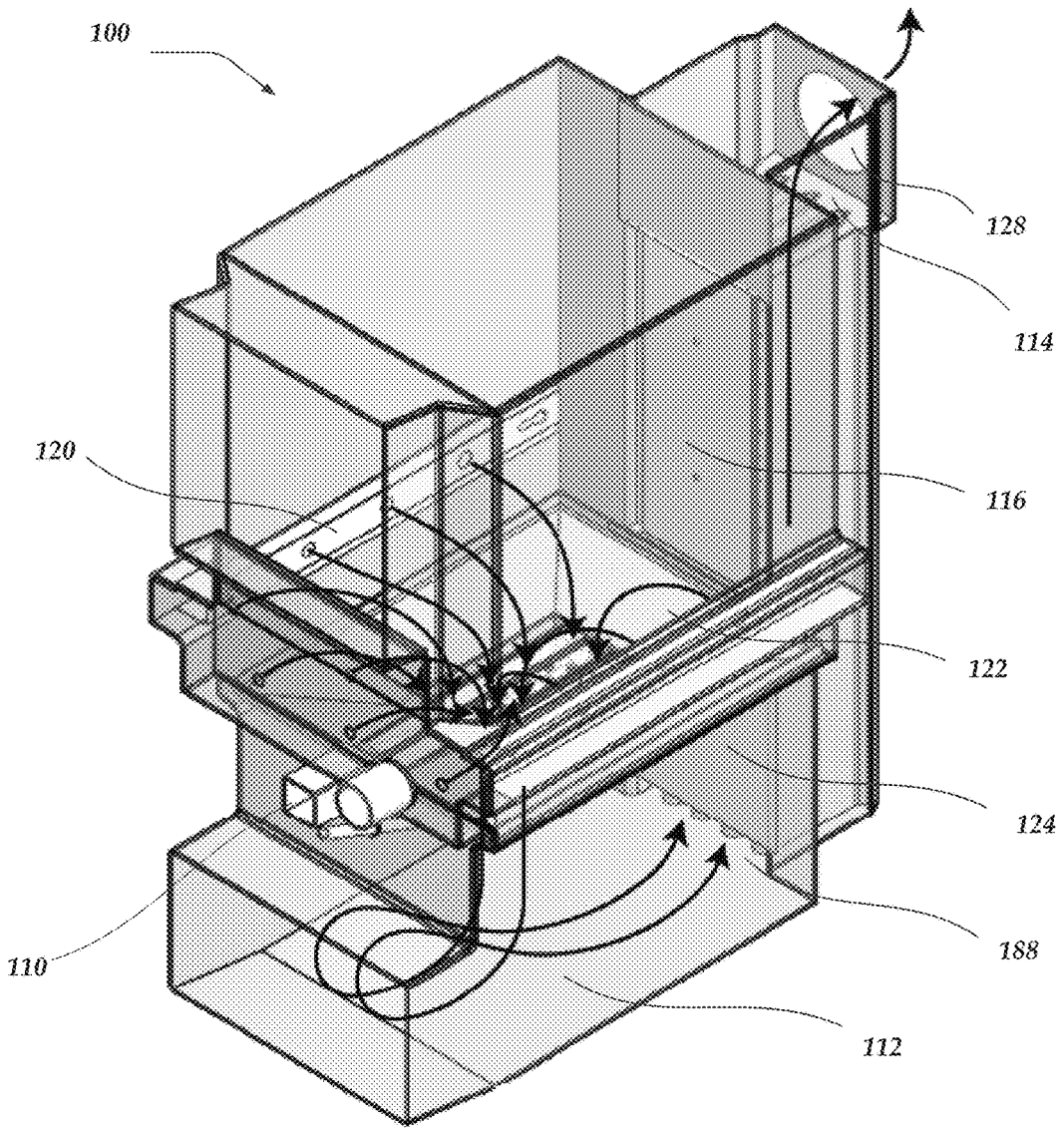
FIG. 3 provides another cutaway view to the interior of the boiler of FIG. 1 that illustrates the heat flow of the combustion/gasification process.

FIG. 3 provides another cutaway view to the interior of boiler 100 of FIG. 1 that illustrates the heat flow of the combustion/gasification process. The crossfire air system 120 adds or injects preheated air to the base of the firebox. The gasified wood flows through the charge tube and into the reaction chamber 112, where the final combustion/gasification occurs. The heated gas flows through gap 188 at the lower portion of the separation panel 124.

The heat flows through or around the vertical radiator fins of heat exchangers 114 to provide heat energy to the water in the water jacket. The heat flows through the upper portion of heat exchangers 114 and out through exhaust duct 128. Removable panel 116 is clearly shown in FIG. 3. Removable panel 116 provides access to heat exchangers 114 through the interior of boiler 100.

Figure 4:
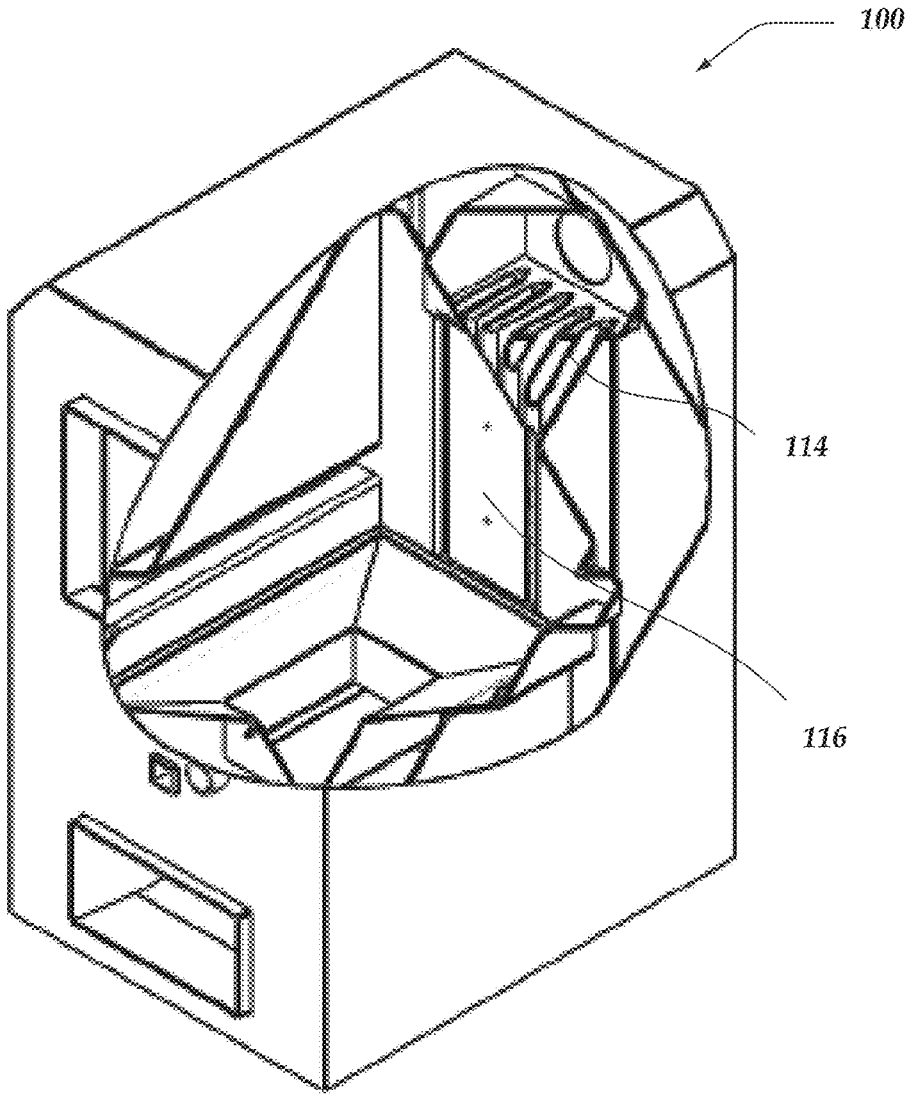
FIG. 4 provides another cutaway view to the interior of boiler of FIG. 1 that illustrates the removable panel that provides access to the heat exchangers from the interior of the boiler.
Figure 5A:
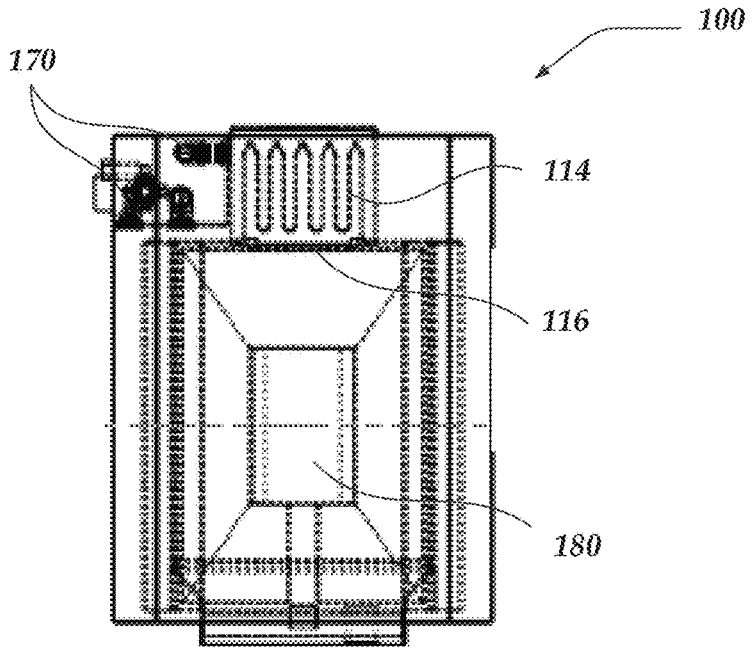
FIG. 5A shows a top view of the interior of the boiler of FIG. 1.

FIG. 4 provides another cutaway view to the interior of boiler 100 of FIG. 1 that illustrates the removable panel 116 that provides access to the heat exchangers 114 from the interior of the boiler 100. FIG. 5A shows a top view of the interior of boiler 100 of FIG. 1. FIG. 5A provides a top view of the recessed portion 180 of the ash pan in the primary combustion chamber. The removable panel 116 that provides access from the interior of boiler 100 to heat exchangers 114 is shown. Portions of piping 170 of the water jacket is shown. These portions provide access to the spaces within the radiator fins of heat exchangers such that the water is heated/vaporized from eat flowing through heat exchangers 114.

Figure 5B:
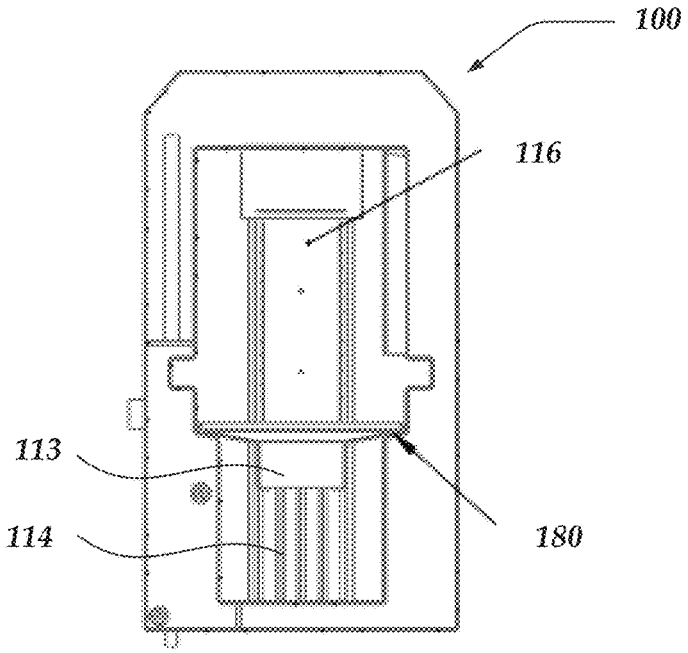
FIG. 5B provides a frontal view of the interior of the boiler of FIG. 1.

FIG. 5B provides a frontal view of the interior of the interior of boiler 100 of FIG. 1, The recessed portion 180 of the ash pan of the primary combustion chamber is visible, as well as the charge tube 110. Removable panel 116 provides access to the heat exchangers 114.

Figure 6A:
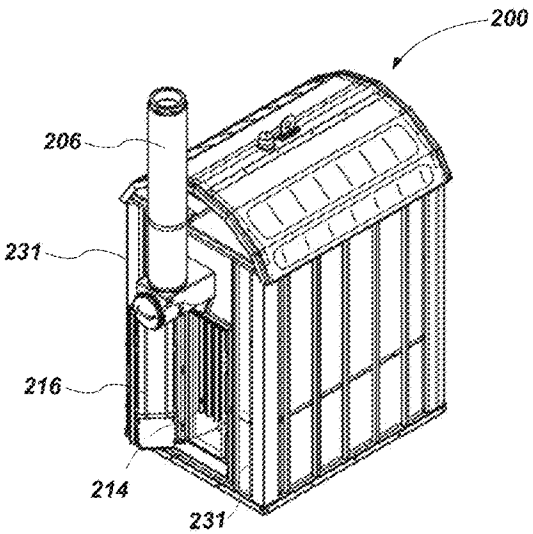
FIG. 6A illustrates an exterior view of a non-limiting exemplary embodiment of a boiler that is consistent with the embodiments disclosed herein.
Figure 6B:
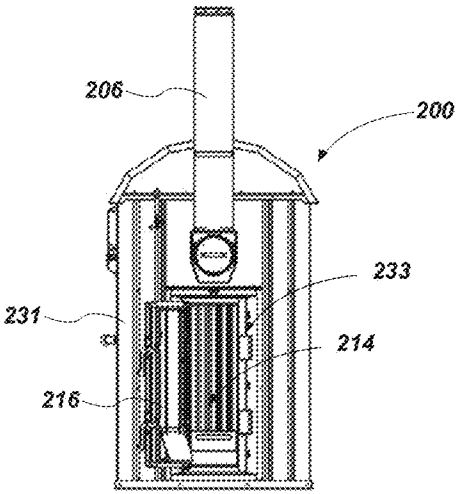
FIG. 6B shows a rear view of the boiler of FIG. 6A.
Figure 6C:
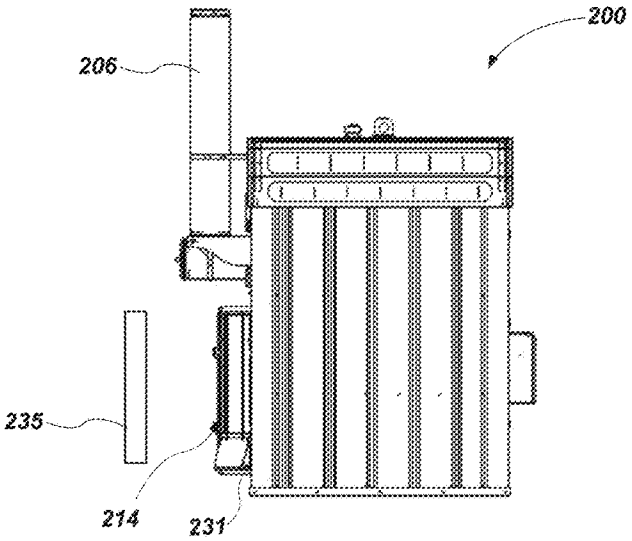
FIG. 6C shows a side view of the boiler of FIG. 6A.
Figure 6D:
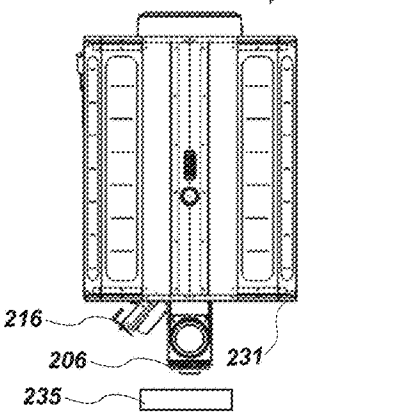
FIG. 6D shows a top view of the boiler of FIG. 6A.
Figure 7A:
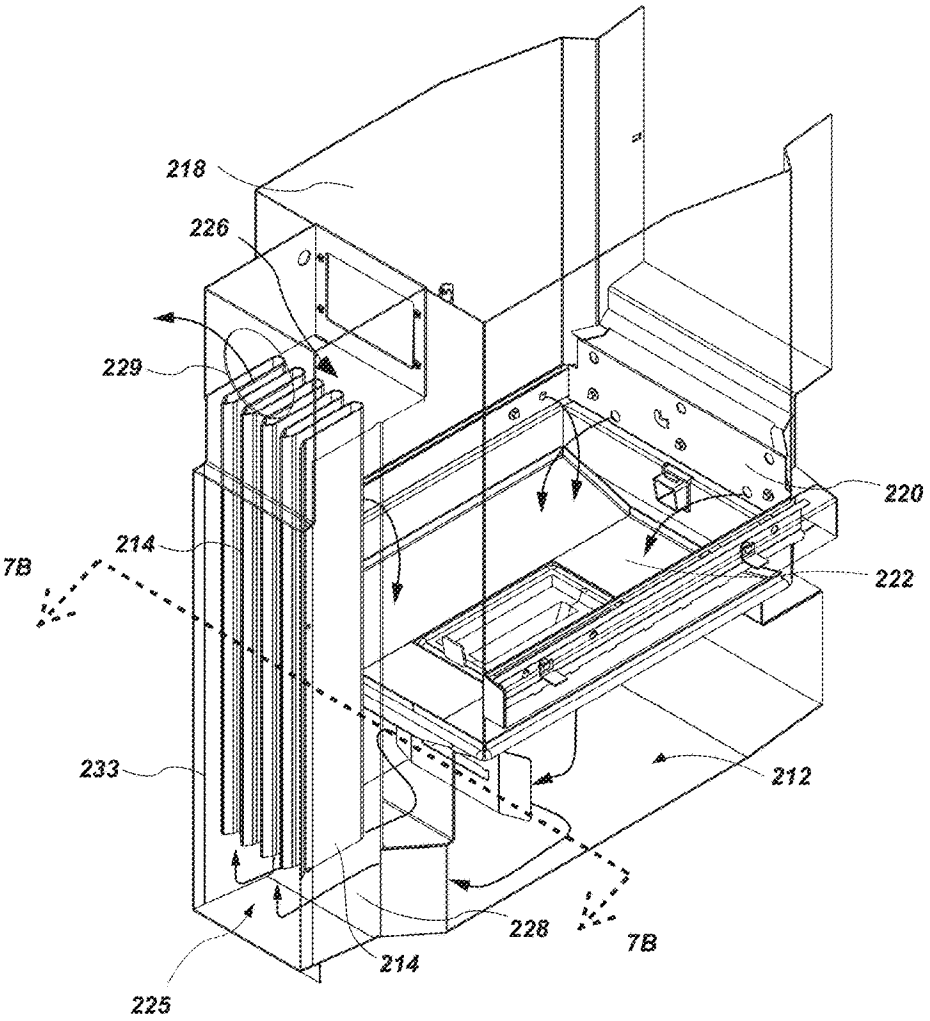
FIG. 7A illustrates a cutaway view to a portion of the interior of the boiler of FIG. 6A.

FIGS. 6A-6D illustrate various views of a non-limiting exemplary embodiment of a boiler 200, and FIG. 7A illustrates a cutaway view of the boiler 200, that are consistent with the embodiments disclosed herein. Although not shown here, the boiler 200 can have similar boiler access ports as described regarding FIG. 1 (e.g., ports 102/182/192) that provides access to the interior of boiler 200, which could be on the front-side of the boiler 200 (hidden from view). The boiler 200 can also include similar plumbing as described regarding FIG. 1.

Figure 7B:
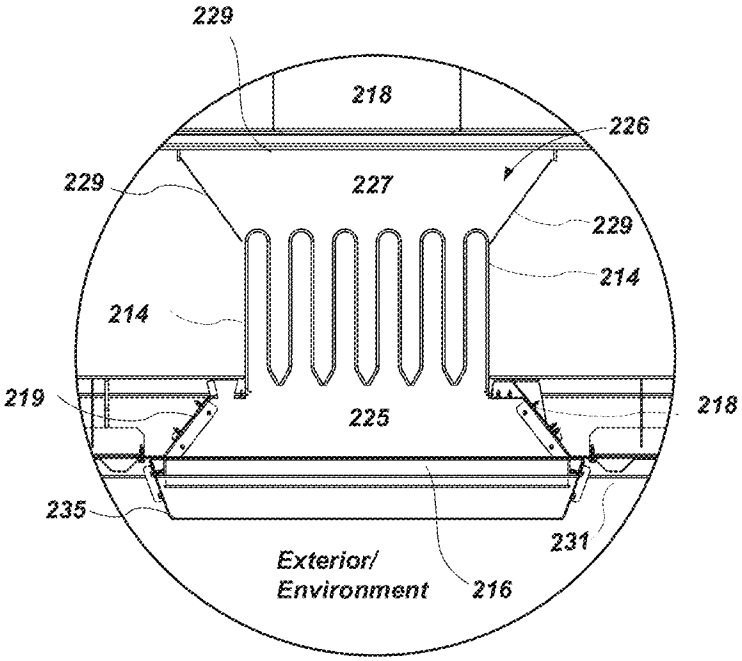
FIG. 7B is a cross sectional view of a portion of the boiler of FIG. 7A, taken along lines 7B-7B.

The interior of boiler 200 includes multiple combustion chambers where a biomass fuel is sequentially combusted and gasified to release the energy required to heat water or fluid within a water or fluid jacket 226 that is internal to boiler 200 (see FIGS. 7A and 7B). The boiler can include a chimney 206 to expel the exhaust and/or heated gases generated from the combustion of the biomass fuel and after the exhaust has transferred a substantial amount of heat to the fluid jacket 226 (see FIG. 7A; see also the description regarding FIG. 2 as an example).

With continued reference to FIG. 7A, biomass fuel, such as wood, is combusted within the firebox or primary combustion channel 218. A crossfire air system 220 injects preheated air around the base of the primary combustion chamber 218. The bottom portion of primary combustion chamber includes an ash pan 222 with a recessed portion for collecting debris from the combustion process. Ash pan 222 enables the easy cleanup, via the upper boiler access port (e.g., see FIG. 1), of coals, ash, and other byproducts generated by the combustion of the biofuel. As the wood begins to gasify, the gases flow downward through a port in ash pan 222. The combustion gasses are added to the heated oxygen in the charge tube (see e.g., 110 of FIG. 2) wherein a secondary combustion process occurs. As the vertically downward arrow indicates, the heated gasses are forced downward into the reaction chamber 212, where the final combustion occurs. As shown by the heat flow arrows, the heated gasses flow from the reaction chamber 212 to the heat exchangers 214 via a gap 228 adjacent and below the heat exchangers 214. These heated gasses transfer heat to the heat exchangers 214, which in turn transfer at least a portion of the heat to water (or gas or other fluid) that is supplied to another structure via plumbing, such as plumbing 104 of FIG. 1.

Boiler 200 includes fluid jacket 226, which can be essentially a closed loop (pressurized or non-pressurized.) fluid system that houses heated fluid to be supplied to another structure, such as a residence or commercial property. Preferably, the heated fluid is water or other fluid in a liquid state. Alternatively, the heated fluid could be heated gas, such as in an open loop system that supplies heated (clean) gases to another structure (in such example, a supply fan may be incorporated into the system, and a return air duct system may be required). At least a portion of the fluid jacket 226 is thermally coupled to heat exchangers 214 so that the fluid (e.g., water) internal to fluid jacket 226 is heated and/or vaporized via the heat released by the combustion of the biomass. The heated water, for instance, within the fluid jacket 226 is circulated away from boiler 200 and provided to the structure via plumbing. After providing at least a portion of the energy to the other structure, the water is circulated back to boiler 100 to be re-thermally energized.

With further reference to FIGS. 7A and 7B, the heat exchangers 214 can include vertical serpentine structures that maximize the area along with the fluid and gases contact the structure on either side to maximize thermal enemy transfer. Thus, in one example the heat exchangers 214 may include fabricated plates. The plates may include a significant surface area to promote efficient heat exchange. The plates may be metal plates. In at least one embodiment, heat exchangers 214 include other heat radiating structures. The increased surface area of these plates provides a greater surface area to thermally couple the heat exchangers 214 to the fluid within the fluid jacket 226. The plates (or fins) define an interface between the flowing heated gasses and the fluid within fluid jacket 226. In at least one embodiment, at least a portion of fluid jacket 226 may include internal channels, pipes, or other plumbing that is internal to the vertical plates. In other embodiments, the heat gases flow through internal channels within the plates and the fluid jacket 226 is on the other side of a wall of the plates.

Thus, as illustrated in FIG. 7B, the heat exchangers 214 can define a gas side area 225 and a water or fluid side area 227, The gas side area 225 can be a chamber or area that allows the flow of heated gases about the heat flow path from about the reaction chamber 212, then upwardly through gas side area 225 of the heat exchangers 214, and then out to the chimney 206 via an aperture 229, as illustrated by the heat path flow arrows. The "gas side area" is the side of the heat exchanger through which combustion gases flow through to the exhaust; however, in the alternative example mentioned above, the "fluid side area" could also contain "clean" gases to be circulated to another structure. Thus, in such example, the heat exchangers could define a clean gas side area and an exhaust gas side area.

The fluid in the fluid jacket 226 can be sealed or contained about the fluid side area 227 via fluid jacket panels 229 that define the fluid side area 227 along with the shape of the heat exchanger 214. The water or other fluid can be flowed in either vertical direction (i.e., upwardly or downwardly) through the fluid side area 227 for circulation through a water or fluid circulation system for heating purposes. The water or other fluid preferably flows upwardly as it is heated.

In the embodiments of FIGS. 6A-7B, the boiler 200 includes a movable access panel 216 positioned about or coupled to an exterior wall 231 of the boiler 200. The movable access panel 216 is movable from a closed position (not shown here) to an open position (FIGS. 6A-6D) to provide access to the heat exchangers 214 from an exterior area of the boiler 200 (i.e., from an environment outside of the exterior walls that define the boiler 200). When in the closed position, the movable access panel 216 covers an access opening 233 (FIG. 6B) formed in the exterior wall 231, so that heated gases moving through the gas side area 225 are sealed or otherwise contained by the movable access panel 216.

As in FIG. 7B, the gas side area 225 can be defined by the shape of the heat exchangers 214, the side walls 219, and the movable access panel 216. The side walls 218 can extend vertically about the boiler 200, and can be coupled to the exterior wall 231. The movable access panel 216 can extend vertically about the boiler 200 and can open along a vertical axis, In the illustrated example of FIG. 7B. at least a portion the fluid jacket 226 is laterally situated or disposed between the combustion chamber 218 and the heat flow path through the gas side area 225 of the heat exchangers 214. And, the gas side area 225 through which the heat flow path traverses is laterally situated or disposed between the movable access panel 216 and at least a portion of the fluid jacket 227. Accordingly, the fluid side area 227 and the gas side area 225 are disposed laterally between e.g., sandwiched between) the combustion chamber 218 and the movable access panel 216. By "laterally" this means along a lateral direction relative to a horizontal plane or axis that extends from the movable access panel 216 to the front side of the boiler 200 (i.e., longitudinally along the length of the boiler 200). It should be appreciated that, because of the serpentine shape of the heat exchangers 214, some of the fluid in the fluid side area 227, and some of the gas in the gas side area 225, are not necessary "laterally situated" relative to each other as discussed above, and rather would be laterally orthogonally situated relative to each other.

The movable access panel 216 can be entirely removable from the boiler 200, or can be hinged to the exterior wall 231 of the panel with one or more hinge devices. The movable panel 216 can be one or more individual panels hinged together. The movable panel 216 can be openable outwardly away from the boiler 200. The movable panel 216 can be a door, hatch, panel, or other suitable device.

The access opening 233 can be sized and shaped such that a majority of (or all of) the heat exchangers 214 are visible by a user, and/or accessible by a tool operable by the user, for inspection and servicing/cleaning of the gas side area 225 of the heat exchangers 214. Because the movable access panel 216 is on an exterior area of the boiler 200, cleaning/inspection can be achieved by a user from an exterior area of the boiler 200, which is advantageous because of the convenience that the user is not required to enter the boiler 200 to clean/inspect the heat exchangers 214. Therefore, the user would not need to completely shut down the boiler to access the heat exchangers 214, which is normally required when entering the boiler because of high temperatures therein. This improves efficiency as a result due to avoiding repeatedly shutting off and on the boiler. Cleaning/inspecting from the internal area of the boiler 200 can be cumbersome and undesirable because of the lack of lighting inside the boiler, and because of the soot and gases that may be within the inside of the boiler. Many users that would normally clean/inspect the heat exchangers 214 may be unskilled homeowners that may avoid frequently entering the boiler for these reasons. However, with the movable access panel 216 being on the outside or exterior of the boiler 200, access is much more convenient and desirable to the user for regular cleaning of the heat exchangers 214.

In some examples, a movable insulating cover panel 235 can cover the movable access panel 216 When in the closed position to thermally insulate gases within the gas side area 225 (see FIGS. 6C and 6D, showing the insulating cover panel 235 exploded form the boiler 200).

All of the embodiments and methods disclosed and claimed herein can be made and executed without undue experimentation in light of the present disclosure. While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A boiler including:

a combustion chamber;

a plurality of heat-exchanging structures that are thermally coupleable to the combustion chamber, the plurality of heat-exchanging structures having a first side and a second side opposite the first side, the first side of the heat-exchanging structures defining a gas side area between an external wall of the boiler and the first side of the heat-exchanging structures, the second side of the heat-exchanging structures defining a fluid side area between the combustion chamber and the second side of the heat-exchanging structures, the gas side area at least partially defining a heat flow path through which heated gases flow from the combustion chamber to heat a fluid in the fluid side area; and a movable access panel positioned about the external wall of the boiler and adjacent the gas side area with the heat-exchanging structures between the movable access panel and the combustion chamber, the movable access panel operable to provide a user access to the gas side area of the plurality of heat-exchanging structures from an exterior of the boiler.

2. The boiler of claim 1, further including a fluid jacket that thermally couples fluid disposable within the fluid jacket to the plurality of heat-exchanging structures.

3. The boiler of claim 2, wherein at least a portion of the fluid within the fluid jacket is in the fluid side area of the plurality of heat-exchanging structures, such that the plurality of heat-exchanging structures physically separates the fluid from the heated gases but thermally couples the fluid to the heated gases.

4. The boiler of claim 2, wherein the fluid jacket comprises a water jacket, and wherein the fluid is water.

5. The boiler of claim 2, wherein at least a portion the fluid jacket is laterally situated between the combustion chamber and the heat flow path through the gas side area of the heat-exchanging structures.

6. The boiler of claim 5, wherein the heat flow path through the gas side area of the heat-exchanging structures is laterally situated between the movable access panel and at least a portion of the fluid jacket.

7. The boiler of claim 1, wherein, when the movable access panel is opened, the gas side area of the plurality of heat-exchanging structures is exposed to an exterior environment for servicing by the user.

8. The boiler of claim 1, wherein the movable access panel is sized and shaped to cover a majority area of the gas side area of the plurality of heat-exchanging structures, such that the majority area of the gas side area is visible or accessible with a cleaning tool when the movable access panel is opened.

9. The boiler of claim 1, wherein the plurality of heat-exchanging structures define separation of a fluid chamber and a heat flow path chamber, the fluid chamber configured to support fluid to be thermally conductively heated via the plurality of heat-exchanging structures by gasses flowable through the heat flow path chamber about the gas side area, wherein the movable access panel covers at least a portion of the heat flow path chamber.

10. The boiler of claim 1, wherein the movable access panel is operable to move from a closed position to an open position, wherein, when in the open position, the plurality of heat-exchanging structures are exposed, and, when in the closed position, the plurality of heat-exchanging structures are covered such that gases flowing through the gas side area are sealed by the closed movable access panel.

11. A boiler including:

a combustion chamber;

a plurality of heat-exchanging structures that are thermally coupleable to the combustion chamber, the heat-exchanging structures having a first side and a second side opposite the first side, the first side of the heat-exchanging structures defining a first side area between the combustion chamber and the first side of the heat-exchanging structures, the second side of the heat-exchanging structures defining a second side area between an external wall of the boiler and the second side of the heat-exchanging structures;

a fluid jacket operable to thermally couple fluid disposable within the fluid jacket about a first side area of the plurality of heat-exchanging structures;

a heat flow path at least partially defined by the second side area of the heat-exchanging structures, the heat flow path providing at least a portion of heated gases flowing from the combustion chamber to the second side area of the plurality of heat-exchanging structures to heat fluid within the fluid jacket; and a movable access panel positioned about the external wall of the boiler with the heat-exchanging structures between the movable access panel and the combustion chamber, the movable access panel operable to provide a user access to the second side area of the plurality of heat-exchanging structures from an exterior of the boiler.

12. The boiler of claim 11, wherein the movable access panel is sized and shaped to cover a viewing area of the second side area of the plurality of heat-exchanging structures.

13. The boiler of claim 11, wherein at least a portion the fluid jacket is situated between the combustion chamber and the heat flow path through the second side area of the plurality of heat-exchanging structures.

14. The boiler of claim 13, wherein the heat flow path through the second side area of the plurality of heat-exchanging structures is situated between the movable access panel and at least a portion of the fluid jacket.

15. The boiler of claim 11, wherein the movable access panel is operable to move between a closed position and an open position, wherein, when in the closed position the movable access panel operates to contain or seal gases flowable through the second side area of the plurality of heat-exchanging structures, and, when in the open position, the second side area of the plurality of heat-exchanging structures is exposed to an exterior area of the boiler for servicing by the user.

16. A boiler including:

a combustion chamber;

a plurality of heat-exchanging structures that are thermally coupled to the combustion chamber, the plurality of heat-exchanging structures at least partially defining a fluid side area and a gas side area opposite the heat-exchanging structures from the fluid side area, the fluid side area being between the heat-exchanging structures and the combustion chamber, the gas side area being between an exterior wall of the boiler and the heat-exchanging structures, the fluid side area configured to support fluid thermally coupleable to the plurality of heat-exchanging structures, wherein the gas side area is configured to receive at least a portion of heated gases from the combustion chamber to heat fluid disposable within the fluid side area; and a movable access panel coupled about the exterior wall of the boiler and operable to cover the gas side area when in a closed position with the heat-exchanging structures between the movable access panel and the combustion chamber, the movable access panel operable to move to an open position to provide a user access to the gas side area of the plurality of heat-exchanging structures from an exterior of the boiler.

17. The boiler of claim 16, wherein at least a portion of the gas side area is laterally situated between the fluid side area and the movable access panel.

18. The boiler of claim 16, wherein, when in the open position, the movable access panel exposes at least a portion of the gas side area of the plurality of heat-exchanging structures.

19. A method for servicing a boiler that includes a movable access panel that provides access to a plurality of heat-exchanging structures, the heat-exchanging structures being between the movable access panel and a combustion chamber of the boiler, the method comprising:

transitioning the movable access panel from a closed position to an open position to provide access to the plurality of heat-exchanging structures from an exterior of the boiler;

employing a tool through an access opening being exterior the boiler to clean the plurality of heat-exchanging structures; and transitioning the movable access panel from the open position to the closed position, to prevent access to the plurality of the heat-exchanging structures.

20. The method of claim 19, wherein transitioning the movable access panel position to the open position comprises exposing a gas side area of the plurality of heat-exchanging structures to clean the plurality of heat-exchanging structures.

21. The method of claim 20, wherein transitioning the movable access panel to the closed position comprises sealing or covering the gas side area of the plurality of heat-exchanging structures.

* * * * *